US010112413B2

(12) United States Patent
Yraceburu et al.

(10) Patent No.: US 10,112,413 B2
(45) Date of Patent: Oct. 30, 2018

(54) DRYER CONTROL IN A PRINTER

(71) Applicant: HEWLETT-PACKARD DEVELOPMENT COMPANY, L.P., Houston, TX (US)

(72) Inventors: Robert Yraceburu, Camas, WA (US); Dawn M. Beachnau Hood, Portland, OR (US); Brooke Hoyer, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/290,728

(22) Filed: Oct. 11, 2016

(65) Prior Publication Data

US 2018/0099511 A1 Apr. 12, 2018

(51) Int. Cl.
*B41J 11/00* (2006.01)

(52) U.S. Cl.
CPC ..... *B41J 11/002* (2013.01)

(58) Field of Classification Search
CPC ..... B41J 11/002
See application file for complete search history.

(56) References Cited

U.S. PATENT DOCUMENTS

| | | | | |
|---|---|---|---|---|
| 5,287,123 | A * | 2/1994 | Medin | B41J 11/002 347/102 |
| 5,307,093 | A | 4/1994 | Suzuki et al. | |
| 5,774,155 | A | 6/1998 | Medlin et al. | |
| 6,359,642 | B1 | 3/2002 | Smith et al. | |
| 7,057,141 | B1 | 6/2006 | Moy | |
| 2005/0237370 | A1 * | 10/2005 | Elgee | B41J 11/002 347/102 |
| 2014/0218432 | A1 * | 8/2014 | Walker | B41J 29/377 347/16 |
| 2016/0046133 | A1 * | 2/2016 | Biglari | B41J 11/0085 347/16 |

OTHER PUBLICATIONS

"Digital Printing: on the Printer", 2016, Arlon, 3 pgs http://arlon.com/Objects/Documents/TIPS/TIP_30_DigitalPrintingonthePrinter.pdf.

* cited by examiner

*Primary Examiner* — Bradley Thies
(74) *Attorney, Agent, or Firm* — Dierker & Kavanaugh PC

(57) ABSTRACT

In one example, a processor readable medium having instructions thereon that when executed cause a printer controller to monitor a temperature of a dryer in the printer, continue to apply power to a heating element in the dryer after executing a first print job and before executing a second, next consecutive print job, and turn off the power applied to the heating element if the temperature of the dryer exceeds a threshold temperature while the printer is not printing.

14 Claims, 3 Drawing Sheets

DRYER CONTROL IN A PRINTER

BACKGROUND

Some printers include a heated dryer to actively dry the ink or other printing fluid on the printed article. In page wide inkjet printing, for example, a heated dryer enables faster print speeds.

DRAWINGS

The same part numbers designate the same or similar parts throughout the figures. The figures are not necessarily to scale.

DESCRIPTION

Upon start up or after a printer has been idle, a cold dryer is pre-heated to the desired operational temperature. Print speed may be slowed during dryer pre-heating to allow adequate drying time. A dryer control technique has been developed to help minimize pre-heating print speed reductions by stoking the thermal mass of the dryer while the printer is idle following a cold start print job. Once the dryer reaches operational temperature, heat is retained in the thermal mass of the dryer to reduce the time to reach operational temperature for the next print job. Continuing dryer operation into the idle time between print jobs stokes the dryer thermal mass, reducing or eliminating the time to pre-heat for the next print job.

In one example, the printer controller implements a process to monitor the temperature of the printer dryer and continues to apply power to the heating element in the dryer after executing one print job and before executing the next print job. Power to the heating element is turned off when the temperature of the dryer reaches operational temperature or otherwise exceeds a threshold temperature while the printer is not printing. In one specific implementation, the power applied to the heating element is used as a proxy for temperature to help more effectively heat the dryer thermal mass. For example, where pulse width modulation is used to control the heating element, the controller can monitor the duty cycle of the pulse width modulator to determine when the desired threshold has been reached to turn off the heating element.

Although examples of the new technique were developed to help minimize the adverse effects of dryer pre-heating after a cold start for higher speed page wide inkjet printers, examples are not limited to cold starts or page wide inkjet printers or even to inkjet printers. The examples described herein and shown in the figures illustrate but do not limit the scope of the patent, which is defined in the Claims following this Description.

As used in this document: "and/or" means one or more of the connected things; a "printer" means any kind of printing device; and a "processor readable medium" means any non-transitory tangible medium that can embody, contain, store, or maintain instructions for use by a processor and may include, for example, circuits, integrated circuits, ASICs (application specific integrated circuits), hard drives, random access memory (RAM), read-only memory (ROM), and flash memory.

Figure 1:
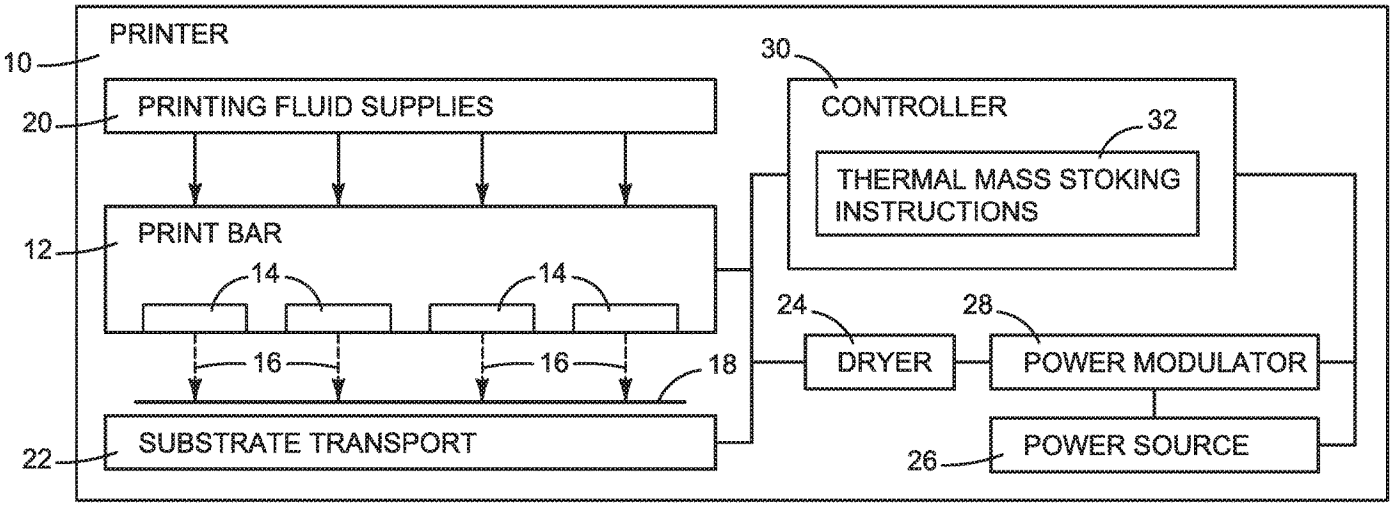
FIG. 1 is a block diagram illustrating one example of a printer with a controller implementing instructions to control the printer dryer.
Figure 3:
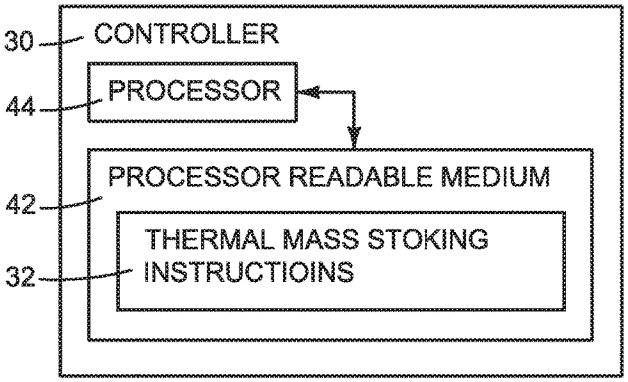
FIG. 3 is a block diagram illustrating the controller in the example printer of FIG. 1 in more detail.
Figure 2:
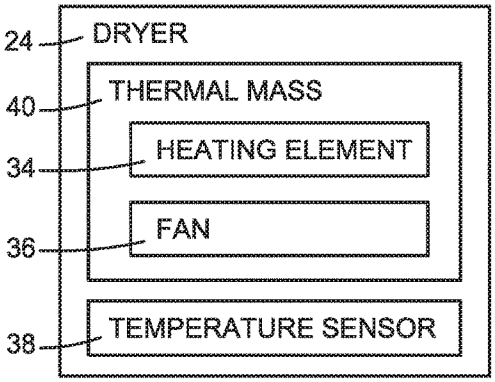
FIG. 2 is a block diagram illustrating the dryer in the example printer of FIG. 1 in more detail.

FIG. 1 is a block diagram illustrating a printer 10 with a controller to implement instructions for stoking the thermal mass of a dryer. FIGS. 2 and 3 illustrate the controller and dryer from FIG. 1, respectively, in more detail. Referring first to FIG. 1, printer 10 includes a print bar 12 with multiple printheads 14 to dispense ink or another printing fluid 16 on to a print substrate 18. Printing fluid supplies 20 supply printing fluid to print bar 12. In this example, a substrate transport system 22 moves substrate 18 past a page wide, stationary print bar 12. Printer 10 also includes a dryer 24 to dry substrate 18 after printing, a power source 26 to power dryer 24, and a power modulator 28 to modulate the power applied to dryer 24. A controller 30 includes the programming, processor and associated memory, and the electronic circuitry and components needed to control the operative elements of a printer 10, including thermal mass stoking instructions 32 to control dryer 24 and power modulator 28 as described below.

Referring now to FIG. 2, dryer 24 includes a heating element 34, a fan 36 to blow heated air into a drying path, and a temperature sensor 38 to measure a temperature of dryer 24. Although not shown, a printer dryer 24 may also include a housing or chassis supporting the operative elements of the dryer and a shroud to direct air flow to the drying path. The parts of dryer 24 form a thermal mass 40 that retains heat generated by heating element 34.

Power modulator 28 (FIG. 1) may be implemented, for example, as a pulse width modulation (PWM) circuit that modulates the power applied to heating element 34 based on feedback from temperature sensor 38, to reach and maintain the desired temperature in dryer 24. A PWM modulator 28 may operate at a high duty cycle to apply maximum power to heating element 34 when the dryer is cold and at lower duty cycles to reduce the power applied to heating element 34 as the dryer temperature reaches the desired operating temperature.

Referring to FIG. 3, controller 30 includes a processor readable medium 42 with stoking instructions 32 and a processor 44 to execute instructions 32. Stoking instructions 32 may be implemented, for example, in ROM or other so-called "firmware" on printer controller 30. Although a printer controller 30 implements thermal mass stoking instructions 32 in the example shown, other configurations are possible. For example, stoking instructions 32 could be implemented in an ASIC or other local controller for dryer 24.

Figure 4:
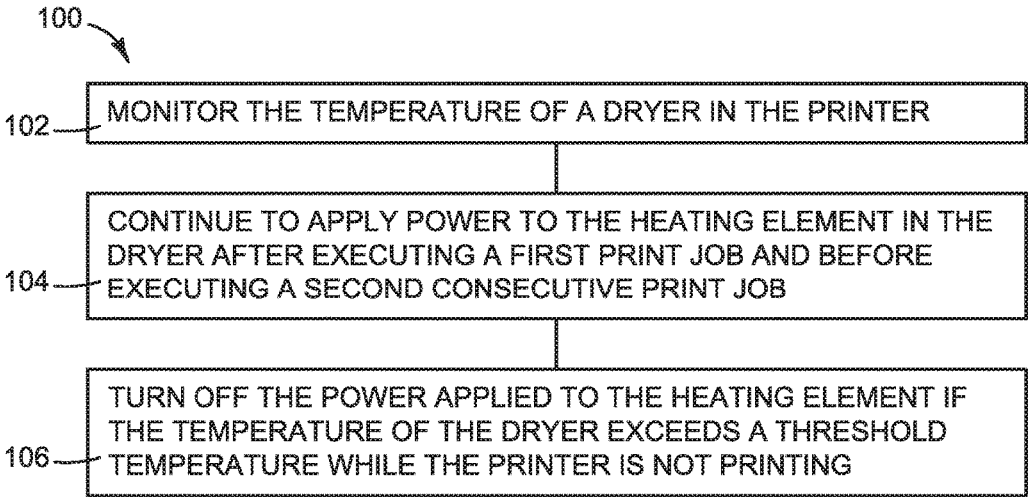
FIGS. 4-7 are flow diagrams illustrating example processes to control a printer dryer, such as might be implemented in the controller shown in FIG. 3.
Figure 5:
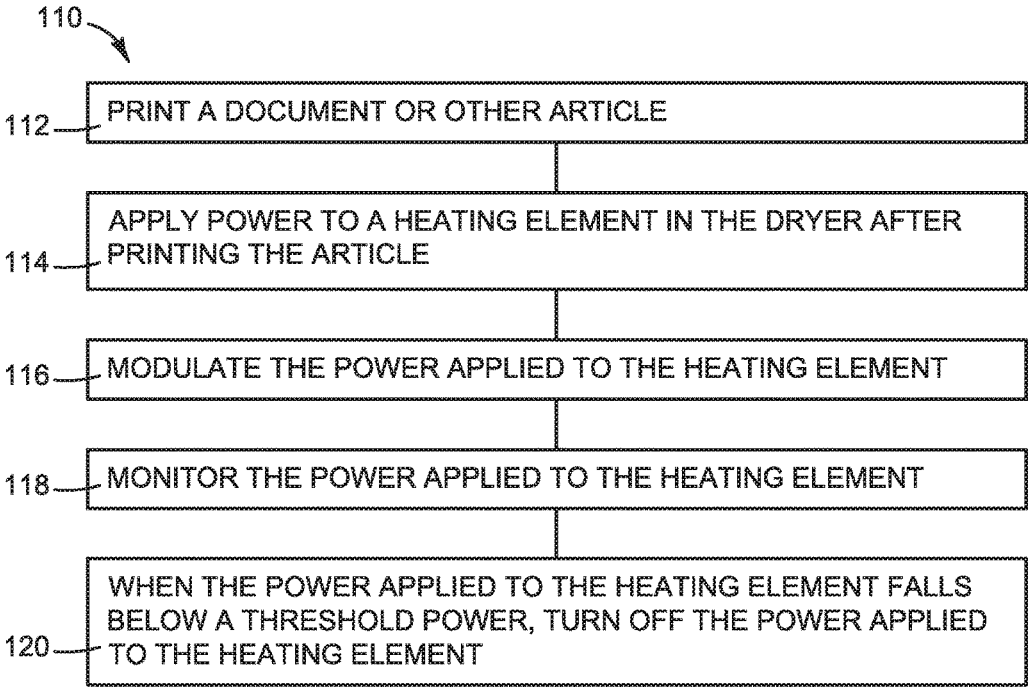
Figure 6:
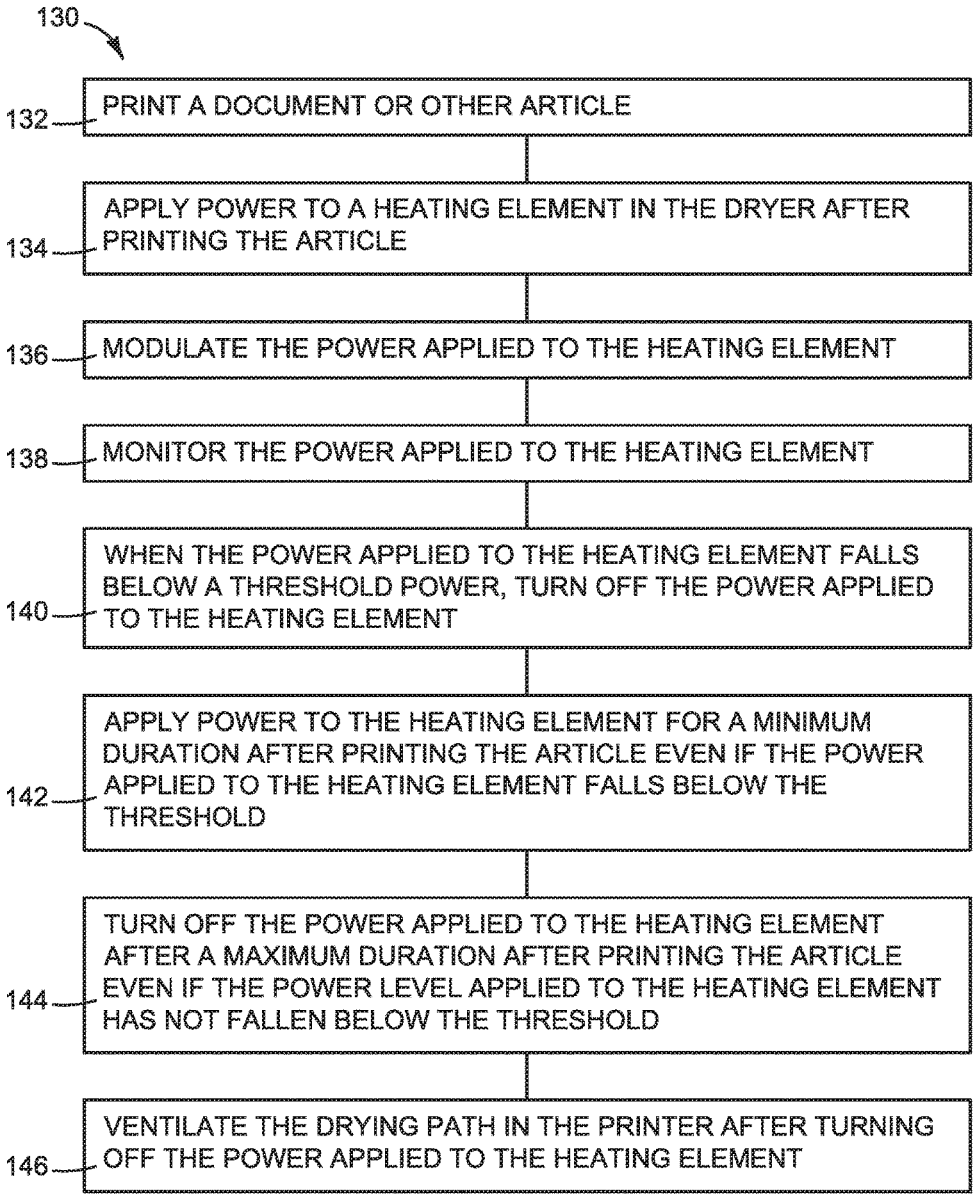

FIG. 4 is a flow diagram illustrating a process 100 for thermal stoking, such as might be implemented with instructions 32 executed by a processor 44 on controller 30 in FIG. 3. (Part numbers in the description of the flow diagrams in FIGS. 4-7 refer to FIGS. 1-3.) Referring to FIG. 4, the temperature of dryer 24 is monitored (block 102) as power continues to be applied to heating element 34 after executing a first print job and before executing a second, consecutive print job (block 104). The power applied to heating element 34 is turned off if the temperature of dryer 24 exceeds a threshold temperature while printer 10 is not printing between the first and second print jobs (block 106).

In some implementations, it may be desirable to monitor the power applied to the heating element as a proxy for temperature to help more effectively stoke the thermal mass of the dryer. For example, where pulse width modulation is used to control the heating element, the controller can monitor the duty cycle of the pulse width modulator to determine when the desired threshold has been reached to turn off the heating element. At the moment the desired dryer temperature is reached, the duty cycle may still be high, near 100% for example, with the dryer mass still absorbing heat. Also, on a low voltage circuit the duty cycle for a pulse width modulator may stay higher longer, allowing the dryer mass to continue to absorb heat. In the stoking process 110 shown in FIG. 5, a document or other article is printed (block 112) and power is applied to heating element 34 after printing the article (block 114). Power to the heating element 34 is modulated (block 116) and the power applied to the heating element 34 is monitored (block 118). When the power applied to heating element 34 falls below a threshold power, then power applied to heating element 34 is turned off (block 120).

In some implementations, it may be desirable to control stoking based on time as well as temperature or power level. Thus, in the stoking process 130 shown in FIG. 6, in addition to power based control at blocks 132-140, power is applied to the heating element for a minimum duration after printing even if the power applied to the heating element falls below the threshold (block 142) and/or the power applied to the heating element is turned off after a maximum duration after printing even if the power level applied to the heating element has not fallen below the threshold (block 144). A minimum post-print duration may be desirable, for example, to keep the power on in the event another print job is already queued up for printing, or to help ensure the printed article has fully cleared the drying path before turning off power to the heating element. A maximum duration may be desirable, for example, to alleviate user concerns that continued power to the heating element may be a malfunction.

Powering dryer heating element 34 to stoke the thermal mass of dryer 24 may cause unwanted heating of printer components in and around the drying path. Thus, it may be desirable in some implementations to ventilate the drying path to dissipate unwanted heat build-up (block 146 in FIG. 6), for example by running dryer fan 36.

Figure 7:
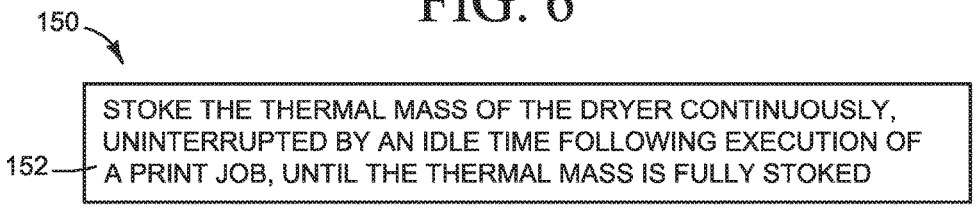

FIG. 7 is a flow diagram illustrating another example process 150 for thermal stoking, such as might be implemented with instructions 32 executed by a processor 44 on controller 30 in FIG. 3. Referring to FIG. 7, the thermal mass of dryer 24 is stoked continuously, uninterrupted by an idle time following execution of a print job, until the thermal mass is fully stoked (block 152). The thermal mass is fully stoked, for example, when dryer 24 reaches a threshold temperature as described above with reference to process 100 in FIG. 4 or when the power applied to heating element 34 falls below a threshold power as described above with reference to process 110 in FIG. 5.

As noted above, the examples shown in the figures and described herein illustrate but do not limit the patent, which is defined in the following Claims.

"A", "an" and "the" used in the claims means one or more. For example, "a heating element" means one or more heating elements and "the heating element" means the one or more heating elements.

The invention claimed is:

1. A non-transitory processor readable medium having instructions thereon that when executed cause a controller to:

monitor a temperature of a dryer in a printer, the dryer to dry printing fluid deposited on an article during a print job by blowing air heated by a heating element of the dryer into a drying path of the article;

continue to apply power to the heating element after executing a first print job and before executing a second, next consecutive print job until the temperature of the dryer exceeds a threshold temperature and the power has been applied to the heating element for a predefined minimum duration of time; and turn off the power applied to the heating element while the printer is not printing the second print job after the temperature of the dryer exceeds the threshold temperature and the power has been applied to the heating element for the predefined minimum duration of time.

2. The processor readable medium of claim 1, where:

the instructions to monitor the temperature of the dryer include instructions to monitor the power applied to the heating element; and the instructions to turn off the power applied to the heating element include instructions to turn off the power applied to the heating element if the power applied to the heating element falls below a threshold power corresponding to the threshold temperature and the power has been applied to the heating element for the predefined minimum duration of time.

3. The processor readable medium of claim 1, having instructions thereon to ventilate a drying path in the printer after turning off the power applied to the heating element.

4. The processor readable medium of claim 1, where the first print job is the first print job after starting the printer.

5. A printer controller implementing the processor readable medium of claim 1.

6. The processor readable medium of claim 1, wherein the instructions to continue to apply the power further cause the controller to continue to apply the power until the temperature of the dryer exceeds the threshold temperature and the power has been applied to the heating element for the predefined minimum duration of time, or until the power has been applied to the heating element for a predefined maximum duration of time, and wherein the instructions to turn off the power further cause the controller to turn off the power after the temperature of the dryer exceeds the threshold temperature and the power has been applied to the heating element for the predefined minimum duration of time, or until the power has been applied to the heating element for a predefined maximum duration of time, while the printer is not printing.

7. The processor readable medium of claim 6, wherein the predefined maximum duration is greater than the predefined minimum duration.

8. The processor readable medium of claim 1, wherein the instructions to continue to apply the power further cause the controller to stoke a thermal mass of the dryer, and wherein the instructions to turn off the power further cause the controller to turn off the power after the thermal mass is fully stoked.

9. A non-transitory processor readable medium having instructions thereon that when executed cause a controller to:

monitor a temperature of a dryer in a printer, the dryer to dry printing fluid deposited on an article during a print job by blowing air heated by a heating element of the dryer into a drying path of the article;

continue to apply power to the heating element after executing a first print job and before executing a second, next consecutive print job if the temperature of the dryer does not exceed a threshold temperature and the power has not been applied to the heating element for a predefined maximum duration of time; and turn off the power applied to the heating element while the printer is not printing the second print job after the power has been applied to the heating element for the predefined maximum duration of time even if the temperature of the dryer does not exceed the threshold temperature.

10. The processor readable medium of claim 9, wherein the instructions to continue to apply the power further cause the controller to continue to apply the power until the power has been applied to the heating element for a predefined minimum duration of time even if the temperature of the dryer exceeds the threshold temperature, and wherein the instructions to turn off the power further cause the controller to turn off the power after the temperature of the dryer exceeds the threshold temperature and the power has been applied to the heating element for the predefined minimum duration of time.

11. The processor readable medium of claim 10, wherein the predefined maximum duration is greater than the predefined minimum duration.

12. The processor readable medium of claim 9, wherein the instructions to continue to apply the power further cause the controller to stoke a thermal mass of the dryer, and wherein the instructions to turn off the power further cause the controller to turn off the power after the thermal mass is fully stoked.

13. A printer controller implementing the processor readable medium of claim 9.

14. The processor readable medium of claim 9, where:

the instructions to monitor the temperature of the dryer include instructions to monitor the power applied to the heating element; and the instructions to turn off the power applied to the heating element include instructions to turn off the power applied to the heating element if the power applied to the heating element falls below a threshold power corresponding to the threshold temperature.

* * * * *